US007562405B2

(12) United States Patent
Brogan

(10) Patent No.: US 7,562,405 B2
(45) Date of Patent: Jul. 21, 2009

(54) PILLOW WITH BAFFLES WITHIN AN OUTER PILLOW SHELL

(75) Inventor: Ruth L. Brogan, Seattle, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 11/671,874

(22) Filed: Feb. 6, 2007

(65) Prior Publication Data

US 2008/0184490 A1 Aug. 7, 2008

(51) Int. Cl.
*A47G 9/10* (2006.01)

(52) U.S. Cl. ..... 5/645; 5/636

(58) Field of Classification Search ..... 5/645, 5/640, 636, 490
See application file for complete search history.

(56) References Cited

U.S. PATENT DOCUMENTS

| | | | | |
|---|---|---|---|---|
| 1,020,444 | A | 3/1912 | Platt | |
| 1,385,355 | A | 7/1921 | Banks | |
| 1,701,124 | A | 2/1929 | Safford | |
| 1,846,312 | A * | 2/1932 | Coghlan | 5/642 |
| 2,167,622 | A * | 8/1939 | Bentivoglio | 5/636 |
| 2,500,974 | A | 3/1950 | Angert | |
| 2,589,303 | A | 3/1952 | Sourbeck | |
| 2,805,428 | A | 9/1957 | Buchman | |
| 2,883,681 | A * | 4/1959 | Caplan | 5/645 |
| 3,594,833 | A * | 7/1971 | Richter | 5/1 |
| 3,849,810 | A | 11/1974 | Degen | |
| 4,192,029 | A * | 3/1980 | Bond | 5/644 |
| 4,309,784 | A | 1/1982 | Cohen | |
| 4,513,462 | A | 4/1985 | Thomas | |
| 4,862,535 | A | 9/1989 | Roberts | |
| 4,949,411 | A | 8/1990 | Tesch | |
| 5,038,432 | A | 8/1991 | Robillard et al. | |
| 5,237,714 | A * | 8/1993 | Baron | 5/636 |
| 5,299,333 | A * | 4/1994 | Pedersen et al. | 5/502 |
| 5,363,524 | A | 11/1994 | Lang | |
| 5,367,731 | A | 11/1994 | O'Sullivan | |
| 5,557,816 | A * | 9/1996 | Pedersen et al. | 5/645 |
| 5,661,862 | A | 9/1997 | Ryndak | |
| 5,809,594 | A | 9/1998 | Isogai | |
| 5,840,080 | A | 11/1998 | Der Ovanesian | |
| 6,052,848 | A | 4/2000 | Kelly | |

(Continued)

FOREIGN PATENT DOCUMENTS

EP 384583 A1 * 8/1990

*Primary Examiner*—Robert G Santos
(74) *Attorney, Agent, or Firm*—Clark A. Puntigam; Jensen & Puntigam, P.S.

(57) ABSTRACT

The pillow includes first and second substantially identical inner shell layers and first and second substantially identical outer shell layers. The first and second inner layers and first and second outer layers are secured together around the peripheries thereof. Extending laterally across the pillow in the width dimension are two spaced baffle members which are secured to the two inner shell layers and extend between the two inner shell layers, defining three chambers along the length of the pillow. The two baffle members either angle away from each other from one longitudinal edge of the pillow to the other longitudinal edge or extend parallel or slightly toward each other from the one longitudinal edge to a point approximately 12 inches from the one longitudinal edge and then curve away from each other to the other longitudinal edge of the pillow.

10 Claims, 3 Drawing Sheets

U.S. PATENT DOCUMENTS

| | | | | |
|---|---|---|---|---|
| 6,170,103 | B1 | 1/2001 | Wang et al. | |
| 6,910,237 | B2 | 6/2005 | DiGirolamo | |
| 6,931,682 | B2 | 8/2005 | Kruger, Jr. | |
| 7,032,264 | B2 * | 4/2006 | Funatogawa | 5/636 |
| 7,120,953 | B2 * | 10/2006 | Ferber et al. | 5/636 |
| 7,152,263 | B1 * | 12/2006 | Delfs | 5/636 |
| 7,346,947 | B2 * | 3/2008 | Kruger, Jr. | 5/645 |
| 7,467,432 | B2 * | 12/2008 | Brogan | 5/636 |
| 2005/0217029 | A1 * | 10/2005 | Funatogawa | 5/645 |
| 2006/0075562 | A1 * | 4/2006 | DiGirolamo | 5/645 |
| 2006/0123547 | A1 * | 6/2006 | Ferber et al. | 5/636 |
| 2006/0277684 | A1 | 12/2006 | Wassilefky | |
| 2008/0250566 | A1 * | 10/2008 | Brogan | 5/645 |

* cited by examiner

FIG.1
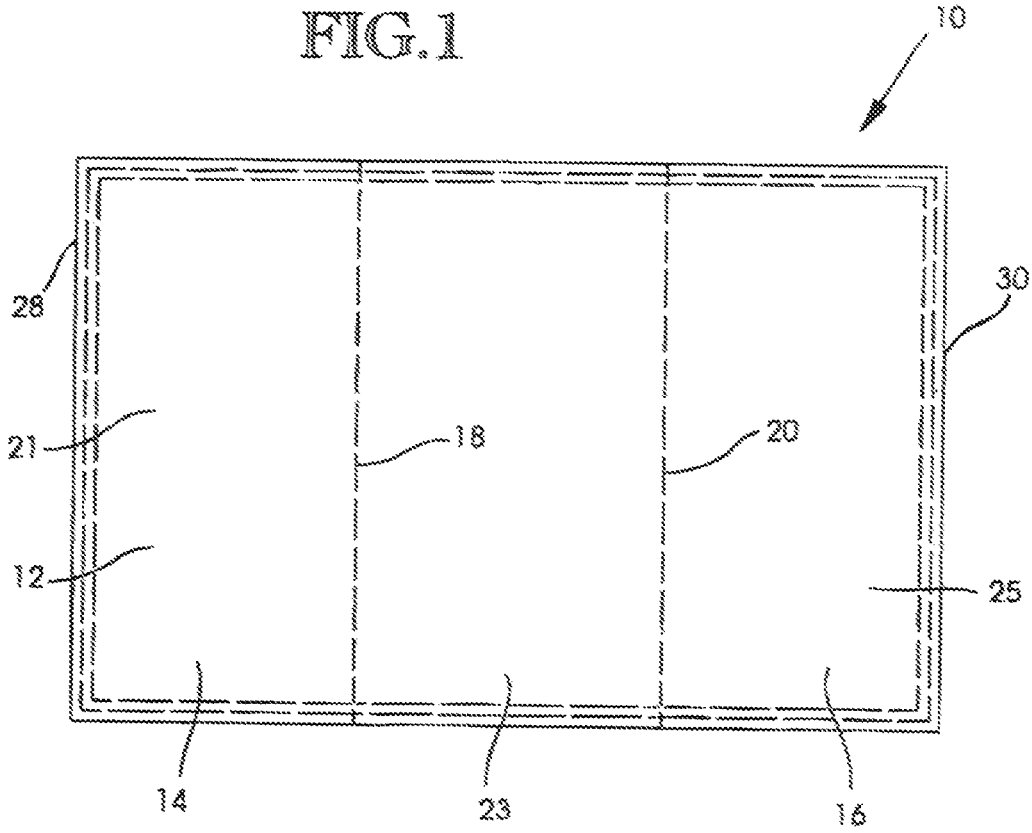
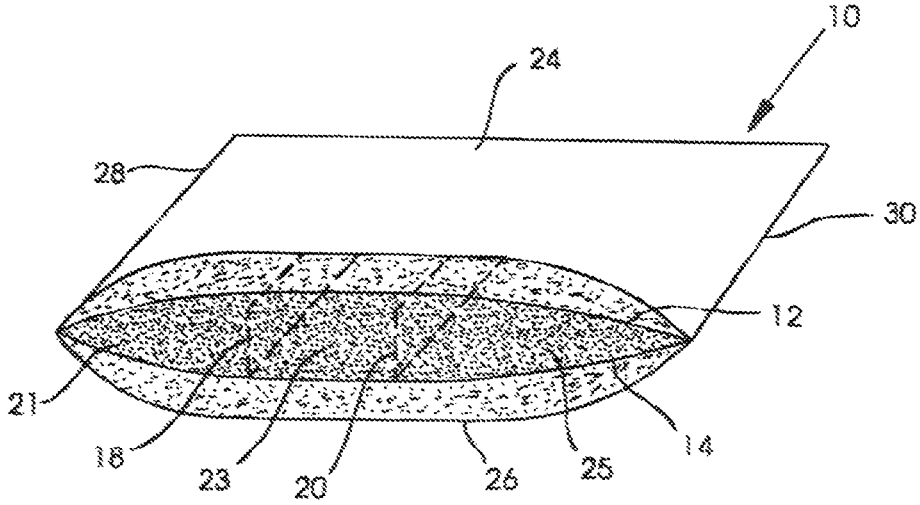
FIG.2

FIG.3
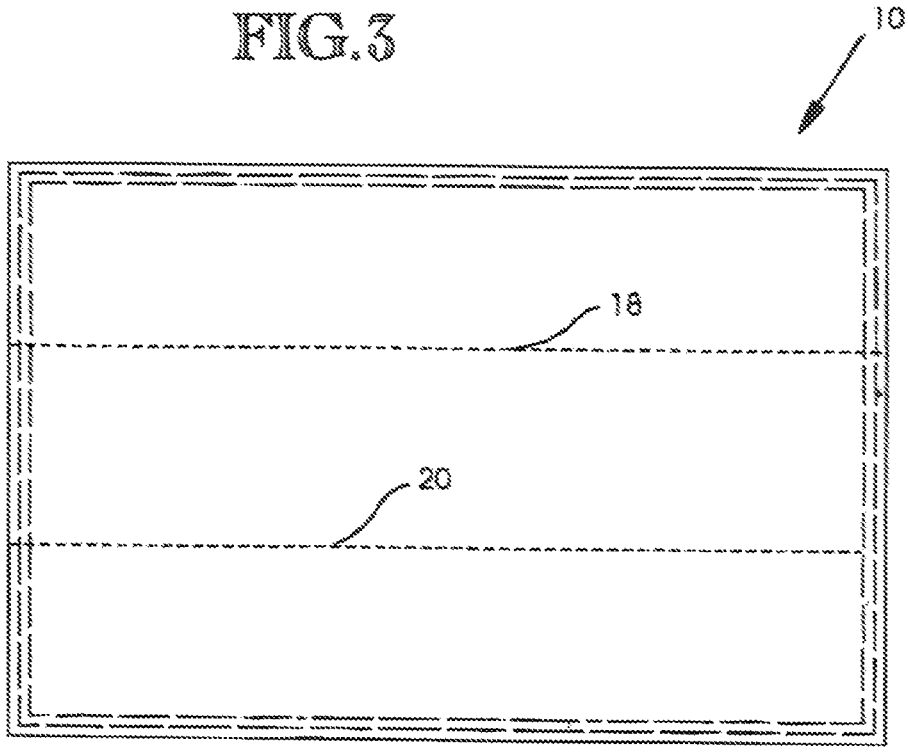
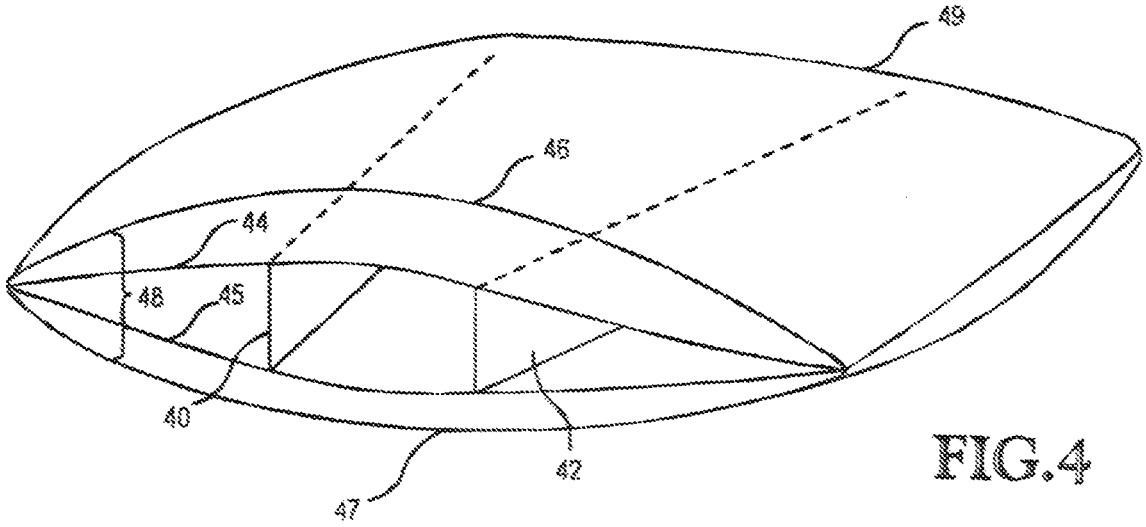
FIG.4

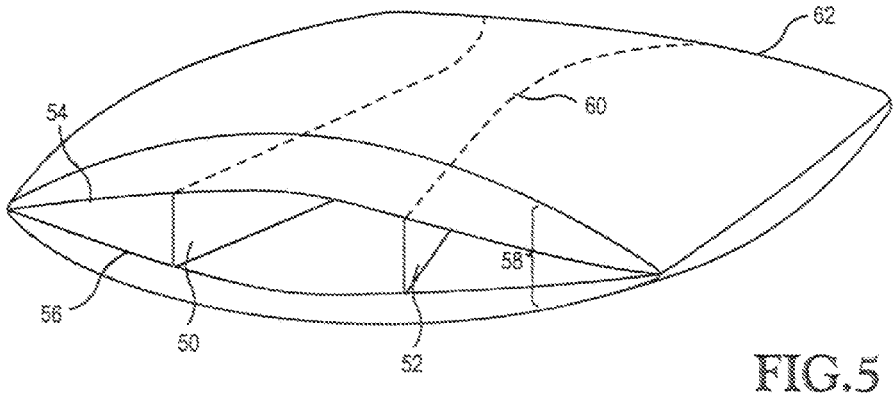
FIG.5
FIG.6
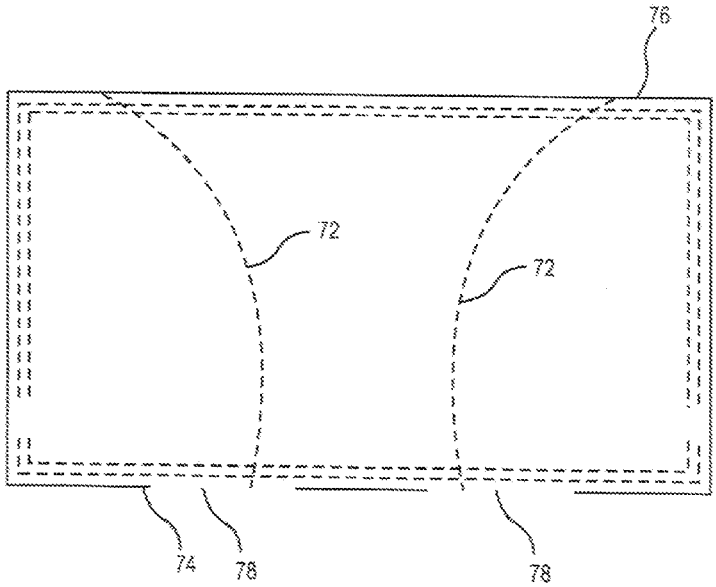

PILLOW WITH BAFFLES WITHIN AN OUTER PILLOW SHELL

TECHNICAL FIELD

This invention relates generally to pillows, and more particularly concerns a pillow with interior chambers.

BACKGROUND OF THE INVENTION

Pillow design/construction includes considerations which can vary significantly. For instance, it is often desirable to restrict the movement of the pillow filling, particularly feathers and down, within a pillow during use. Sometimes this is done with interior walls or baffles, which form interior chambers. Various interior chamber arrangements are known; some examples of relatively simple baffle arrangements defining several interior volumes are shown in U.S. Pat. No. 5,557,816, owned by the assignee of the present invention. Pillows with more complex interior baffle arrangements are known, which provide specialized filling control, but they are expensive to manufacture and therefore for most cases are impractical.

In general, good support for the user is also desirable; support involves not only the structure and configuration of the pillow, but also the particular filling used for the pillow. For instance, feathers traditionally provide good support; polyester foam, another filling, provides a particular kind of support which some consumers prefer.

Still further, the comfort, i.e. "feel" of the pillow, is often an important consideration. The type of filling is important to the feel of a pillow, with down typically providing the best comfort, although with less support than other types of filling.

The present pillow arrangement includes a pillow structure for restricting the movement of the filling during use, while at the same time providing good support and a high degree of comfort for the user.

SUMMARY OF THE INVENTION

Accordingly, the present embodiment of the new pillow comprises: first and second substantially identical inner shell layers, each having a length and width, secured together around the peripheries thereof; two baffle members extending between and secured to the first and second inner shell layers, the baffle members extending from the vicinity of one longitudinal edge across the width of the pillow to the vicinity of the opposing longitudinal edge, defining a plurality of interior chambers between the first and second inner shell layers, wherein the two baffle members angle or curve relative to each other along at least a portion of the lengths thereof; first and second substantially identical outer shell layers, secured in a non-openable manner around the peripheries thereof to the peripheries of the first and second inner shell layers; and pillow filling located in the spaces between the inner and outer shell layers and in said interior chambers.

BRIEF DESCRIPTION OF THE DRAWINGS

FIG. 1 is a top view of the pillow of FIG. 1.

FIG. 2 is a perspective view showing the structure of the pillow of the present invention.

FIG. 3 is a top view of an alternate arrangement of the pillow of FIG. 1.

FIG. 4 is a perspective view of one alternative embodiment to the pillow of FIGS. 1-3.

FIG. 5 is a perspective view of another alternative embodiment to the pillow of FIGS. 1-3.

FIG. 6 is a top view of another alternative embodiment to the pillow of FIGS. 1-3.

BEST MODE FOR CARRYING OUT THE INVENTION

FIGS. 1 and 2 show an embodiment of the pillow of the present invention. The pillow, referred to generally at 10, includes two identical inner fabric layers or shells 12 and 14. In the embodiment shown, the inner fabric layers are typically a cotton or similar fabric such as polycotton, or a non-woven fabric, and are 26 inches long by 20 inches wide, although these dimensions can be varied, depending upon the desired size of the pillow. The two inner fabric layers 12 and 14 are stitched together around most of the respective peripheries thereof, leaving an open space along one longitudinal edge 16 of sufficient length to permit filling of the pillow.

Connected interiorly between the two inner fabric layers 12 and 14 are two identical baffles 18 and 20. In the embodiment shown, the baffles are also a cotton or similar fabric and are typically 6-8 inches high, although this can vary, depending on the particular design. Baffles 18 and 20 extend for the full width laterally of the pillow and are located so as to define three chambers, 21, 23, 25 of equal size along the length of the pillow 10.

While the embodiment shown includes two spaced baffles, it should be recognized that a single baffle or more positioned differently to produce different size chambers. Still further, while the baffle members are shown extending laterally, i.e. across the width, of the pillow, they could also extend along the length, i.e. longitudinally, of the pillow. Also, while it is preferred that baffle members 18 and 20 extend for the full width (or length) of the pillow, it is possible that the baffle members could extend to within a small distance of the opposing edge of the pillow, attached to the inner fabric layers, and therefore not extend for the full width or length of the pillow.

The baffle members 18 and 20 are attached to the inner fabric layers by stitching or other similar means. The baffle members are intended to provide a barrier for the filling, to prevent migration of the filling in the pillow during use, particularly from the center of the pillow outward toward the opposing lateral edges 28 and 30 of the pillow.

The pillow 10 also includes two outer fabric layers or shells 24 and 26. Outer fabric layers 24 and 26 in the embodiment shown are substantially identical in size and configuration and are the same material as inner fabric layers 12 and 14. The outer fabric layers 24 and 26 are secured around their respective peripheries to the inner fabric layers 12 and 14.

Filling is then blow into the pillow, such as by conventional blowing techniques. In the embodiment shown, chambers 21, 23, and 25 defined between the inner fabric layers 12 and 14 and the baffle members 18 and 20 are filled with feathers. The space between the inner fabric layers 12 and 14 and the outer fabric layers 24 and 26 are filled with down. This arrangement provides the combination of good internal support, with the feather filling and the baffle members preventing migration of the feathers during use, while the down filling between the inner and outer layers provides comfort and a good "feel" for the user, as well as a feather barrier.

However, it should be understood that other fillings can be used as well, including polyester filling, other fiber material and PLA (polyactic acid) or any combination of the above. The concept of the pillow described herein is not necessarily limited to a particular filling arrangement.

After the pillow has been filled, the open portion of the longitudinal edge 16 is closed, completing the pillow.

Accordingly, a pillow has been described and shown which includes an interior structure with two inner layers, two internal baffle members and two outer layers which provides good comfort with good support while a the same time being practical to manufacture.

One additional embodiment is shown in FIG. 4. This embodiment includes a different arrangement of baffle members for the interior of the pillow, in particular baffle members 40 and 42. The remainder of the pillow, including the outer fabric layers 46 and 47, the inner fabric layers 44 and 45 and the filling within the various interior volumes of the pillow is the same as for the above-described embodiments. Baffle members 40 and 42 are fabric, sewn to the inner fabric layers 44 and 45 and extend across the width of the pillow, beginning at or in the vicinity of one longitudinal edge 48 thereof and extending to or in the vicinity of the opposing longitudinal edge 49. Baffle members 40 and 42 are straight, and angle outwardly, i.e. away from each other, across the pillow from edge 48 to edge 49. The angle between the two baffle members is in the range of 12°-16°, and is preferably approximately 14°. The distance between the two baffle members 40 and 42 at edge 46 is approximately 8-12 inches, depending on the size of the pillow. The larger the pillow, the greater the distance.

A further embodiment is shown in FIG. 5, in which two interior baffle members 50 and 52 are curved over at least a part of their length. The remainder of the pillow has the same construction and arrangement as the other pillows shown and described herein relative to the outer and inner fabric layers and the filling. In FIG. 5, the two baffle members 50, 52 are fabric and are sewn to the inner fabric layer 54 and 56 and extend across substantially the width of the pillow, beginning at or in the vicinity of one edge 58. The baffle members parallel each other for approximately 12 inches or so, to a point in the middle third or typically slightly greater than a midpoint 60 of the width of a 20-inch pillow, or alternatively angle or curve slightly toward each other to point 60 and then curve away from each other to or in the vicinity of the opposite edge 62. In the embodiment shown, the two baffle members 50 and 52 are separated by a distance of approximately 8-12 inches at edge 58 and approximately 15-21 inches at edge 62, and are approximately 8-12 inches at point 60.

FIG. 6 shows a still further embodiment, in which the two baffle members 70 and 72 curve slightly toward each other from edge 74 and then curve away from each other to the opposing edge 76. The distance between the baffles 70 and 72 at edge 76 is substantially greater than the distance between the baffles at edge 74. Fill is blown in through openings 78, after which the openings are closed.

Although a preferred embodiment of the invention has been disclosed for purpose of illustration, it should be understood that various changes, modifications and substitutions may be incorporated in the embodiment without departing from the spirit of the invention which is defined by the claims which follow.

What is claimed is:

1. A bed pillow, comprising:

first and second substantially identical rectangular inner shell layers, each having a length and width, secured together in a non-openable manner around the peripheries thereof;

two baffle members extending between and secured to the first and second inner shell layers, the baffle members extending from a first longitudinal edge across the width of the pillow to an opposing second longitudinal edge, without contacting each other, thereby defining a plurality of interior chambers between the first and second inner shell layers which extend uninterruptedly between the first and second longitudinal edges, wherein the two baffle members angle or curve relative to each other along at least a portion of the lengths thereof and wherein the baffle members are separated by a distance at the second longitudinal edge greater than the distance at the first longitudinal edge in order to produce different size chambers preventing movement of filling during use, to maintain support and comfort for a user;

first and second substantially identical rectangular outer shell layers, secured in a non-openable manner around the peripheries thereof to the peripheries of the first and second inner shell layers; and pillow filling located in the spaces between the inner and outer shell layers and in said interior chambers.

2. The pillow of claim 1, wherein the two baffle members are straight and angle away from each other from said first longitudinal edge to said opposing longitudinal edge.

3. The pillow of claim 2, wherein the angle between the baffle members is within the range of 12-16°.

4. The pillow of claim 3, wherein the angle is approximately 14°.

5. The pillow of claim 2, wherein the baffle members are separated by a distance between 8-12 inches at the first longitudinal edge thereof.

6. The pillow of claim 1, wherein the two baffle members are parallel or extend somewhat toward each other from said first longitudinal edge to a point within the middle third of the width of the pillow and then curve away from each other to the second longitudinal edge thereof.

7. The pillow of claim 6, wherein the baffle members are separated by approximately 8-12 inches at the center of the pillow.

8. The pillow of claim 1, wherein the two baffle members curve toward each other from said first longitudinal edge to a point within the middle third of the width of the pillow and then curve away from each other to the second longitudinal edge thereof.

9. The pillow of claim 1, wherein the baffle members are separated by a distance at the second longitudinal edge substantially greater than the distance at the first longitudinal edge.

10. The pillow of claim 1, wherein the two baffle members are positioned at approximately 90° relative to the first and second shell layers.

* * * * *